US011417982B2

(12) United States Patent
Nakamura

(10) Patent No.: US 11,417,982 B2
(45) Date of Patent: Aug. 16, 2022

(54) CONNECTOR

(71) Applicant: HIROSE ELECTRIC CO., LTD., Kanagawa (JP)

(72) Inventor: Koichi Nakamura, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 144 days.

(21) Appl. No.: 17/064,107

(22) Filed: Oct. 6, 2020

(65) Prior Publication Data

US 2021/0111507 A1 Apr. 15, 2021

(30) Foreign Application Priority Data

Oct. 10, 2019 (JP) ..... JP2019-186464

(51) Int. Cl.

| | |
|---|---|
| ***H01R 13/62*** | (2006.01) |
| ***H01R 13/514*** | (2006.01) |
| ***H01R 13/516*** | (2006.01) |
| ***H01R 12/79*** | (2011.01) |

(52) U.S. Cl.

CPC ..... *H01R 13/514* (2013.01); *H01R 12/79* (2013.01); *H01R 13/516* (2013.01)

(58) Field of Classification Search

CPC ..... H01R 12/77; H01R 12/79; H01R 13/514; H01R 13/516; H01R 13/518

USPC ..... 439/152, 153

See application file for complete search history.

(56) References Cited

U.S. PATENT DOCUMENTS

| | | | | |
|---|---|---|---|---|
| 2014/0069712 | A1* | 3/2014 | Montevirgen | H01R 13/516 174/650 |
| 2021/0111507 | A1* | 4/2021 | Nakamura | H01R 12/79 |
| 2021/0218169 | A1* | 7/2021 | Yang | H01R 13/652 |

FOREIGN PATENT DOCUMENTS

| | | | |
|---|---|---|---|
| JP | 2019-133892 | A | 8/2019 |

* cited by examiner

*Primary Examiner* — Khiem M Nguyen

(74) *Attorney, Agent, or Firm* — Rankin, Hill & Clark LLP

(57) ABSTRACT

A connector includes a housing fittable with a fitted portion of a counterpart housing of a counterpart connector. The housing includes a base and a fitting portion. The fitting portion is integrated with the base and fittable with the fitted portion. The fitting portion extends in a direction intersecting a fitting direction with respect to the counterpart housing and faces the base. The fitting portion includes a wall configured to close an opening of the fitted portion when the fitting portion is fitted with the fitted portion.

8 Claims, 15 Drawing Sheets

CONNECTOR

CROSS-REFERENCE TO RELATED APPLICATION

This application claims priority from Japanese Patent Application No. 2019-186464 filed with the Japan Patent Office on Oct. 10, 2019, the entire content of which is hereby incorporated by reference.

BACKGROUND

1. Technical Field

The present disclosure relates to a connector connectable to a counterpart connector by fitting.

2. Related Art

A known connector is fittable with a counterpart connector. When the connector is fitted with the counterpart connector, a terminal of the connector is connected to a counterpart terminal of the counterpart connector. The connector is attached to a cable, and the counterpart connector is mounted on a board. The terminal of the connector is disposed on a tip of the cable and housed inside a housing of the connector. The counterpart terminal of the counterpart connector is housed inside a counterpart housing of the counterpart connector and connected to a circuit mounted on the board.

For example, a flat-conductor connector disclosed in JP-A-2019-133892 includes a board-side connector and a relay connector. The board-side connector includes a fixed housing including a housing chamber. A relay housing is disposed in the housing chamber. The relay connector includes a relay housing and a lock member. The relay housing includes a connection chamber, and a flat conductor is disposed in the connection chamber. The lock member holds the flat conductor with no gap between the flat conductor and the connection chamber by pressing the flat conductor in the relay housing against an inner wall of the connection chamber in a thickness direction.

SUMMARY

A connector includes a housing fittable with a fitted portion of a counterpart housing of a counterpart connector. The housing includes a base and a fitting portion. The fitting portion is integrated with the base and fittable with the fitted portion. The fitting portion extends in a direction intersecting a fitting direction with respect to the counterpart housing and faces the base. The fitting portion includes a wall configured to close an opening of the fitted portion when the fitting portion is fitted with the fitted portion.

DETAILED DESCRIPTION

Figure 1:
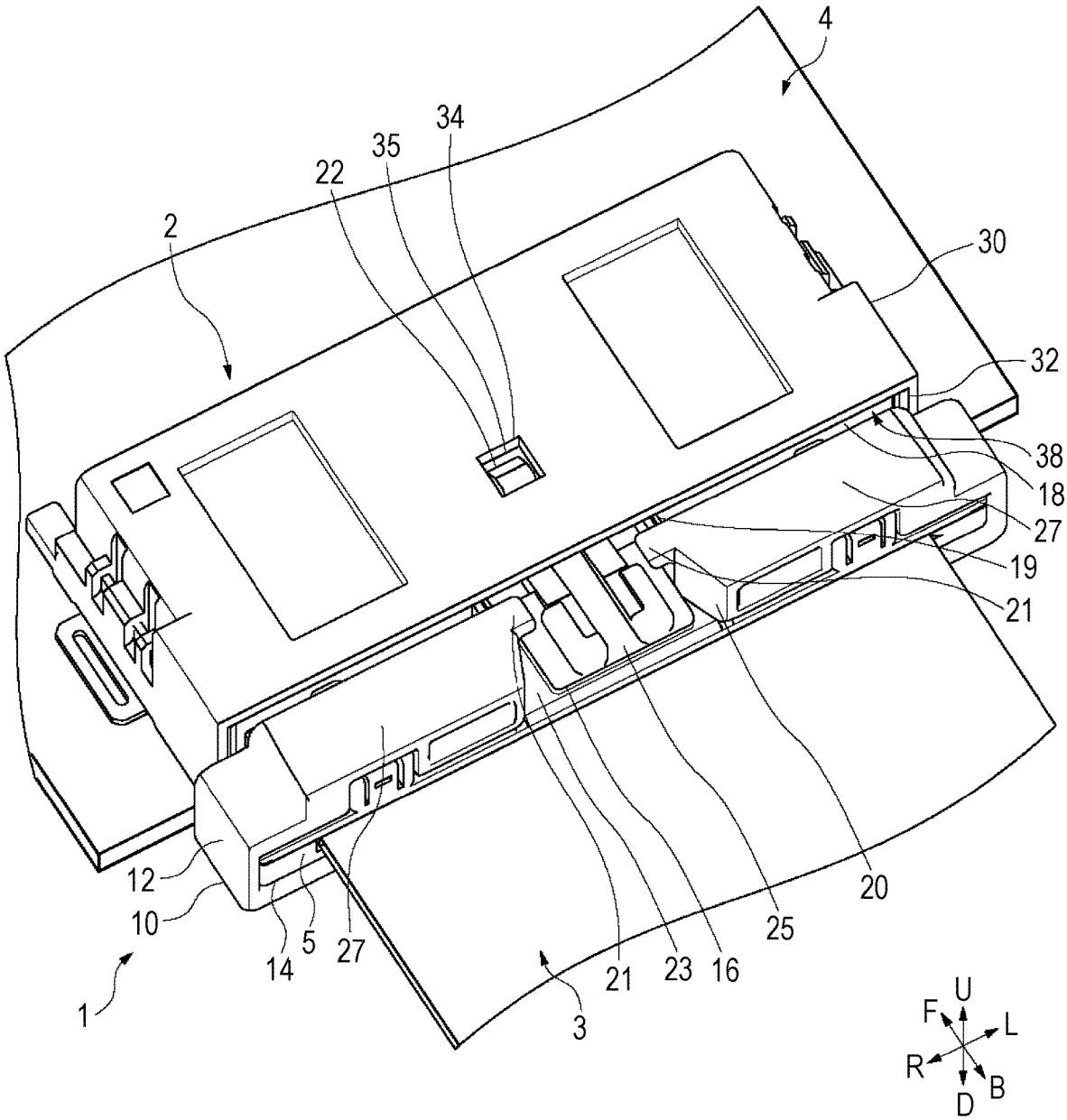
FIG. 1 is a perspective view illustrating a state where a connector according to an embodiment of the invention is fitted with a counterpart connector.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

When the cable to be attached with the connector is configured as the flat conductor, such as an FPC or an FTC as described above, the connector is long in the width direction to house the flat conductor that is wide in the width direction. Moreover, to achieve reliable fitting and connection with the counterpart connector, a fitting part of the connector is long in a fitting direction. Thus, the fitting part of the connector has a wide upper face. When the connector is tightly fittable with the counterpart connector, it is difficult to attach or detach the connector to or from the counterpart connector. Thus, the fitting part has an outer diameter smaller than an inner diameter of the counterpart connector.

When condensation occurs on the connector, water droplets adhere to an upper face of the connector. A clearance is left between the upper face of the connector and an inner wall of the counterpart connector. Thus, the water droplets adhering to the upper face may enter the inside of the counterpart connector due to, for example, a capillary phenomenon. When the water droplets reach a connection part between the terminal of the connector and the counterpart terminal of the counterpart connector inside the counterpart connector, the water droplets may cause a trouble such as a short circuit in an electric circuit or a connection failure.

The above flat-conductor connector disclosed in JP-A-2019-133892 can reduce the gap between the flat conductor and the connection chamber inside the relay connector. However, it is difficult to reduce a clearance between the board-side connector and the relay connector, which makes it difficult to reduce entry of water droplets into the board-side connector.

The present disclosure has been made, for example, in view of the above problems, and an object thereof is to provide a connector capable of reducing entry of water droplets adhering to the connector due to condensation into a counterpart connector.

In order to solve the above problems, a connector according to an embodiment of the invention includes a housing fittable with a fitted portion of a counterpart housing of a counterpart connector. The housing includes a base and a fitting portion. The fitting portion is integrated with the base and fittable with the fitted portion. The fitting portion extends in a direction intersecting a fitting direction with respect to the counterpart housing and faces the base. The fitting portion includes a wall configured to close an opening of the fitted portion when the fitting portion is fitted with the fitted portion.

In the connector according to the above embodiment of the invention, the wall preferably defines a groove on an outer face of the housing. The groove is preferably continuous from an upper face to a side face of the housing and further extends downward.

Preferably, the connector according to the above embodiment of the invention further includes a locking piece configured to lock the housing to the counterpart housing, the locking piece being disposed on an outer face of the housing. The locking piece preferably has a first end connected to the outer face of the housing and a second end separated from the outer face of the housing. The wall is preferably disposed in a region other than a disposing region of the locking piece on the outer face of the housing. The housing preferably includes a first inclined surface inclined downward in a removal direction of the housing in the disposing region of the locking piece at the second end side. Moreover, the locking piece may include, on an upper face, a second inclined surface inclined toward the first inclined surface, or may include, on the upper face, a third inclined surface inclined downward in the removal direction of the housing.

In the connector according to the above embodiment of the invention, the base preferably includes, on an upper face, a fourth inclined surface inclined downward in a removal direction of the housing. Moreover, the wall preferably includes, in an upper edge part in a removal direction of the housing, a fifth inclined surface inclined downward in the removal direction of the housing.

Preferably, the connector according to the above embodiment of the invention further includes a holder attached to the housing while positioning a cable. The first inclined surface preferably includes a cut on an end in the removal direction. The holder preferably includes, on an upper face, a sixth inclined surface inclined downward in the removal direction of the housing at a position corresponding to the cut when the holder is attached to the housing.

According to the embodiment of the invention, it is possible to reduce entry of water droplets adhering to a connector due to condensation into a counterpart connector.

A connector 1 according to an embodiment of the invention will be described with reference to the drawings. Note that, in the embodiment of the invention, description will be made with reference to up (U), down (D), front (F), back (B), left (L), and right (R) directions indicated by arrows in FIGS. 1 to 13 for convenience of description.

Figure 2:
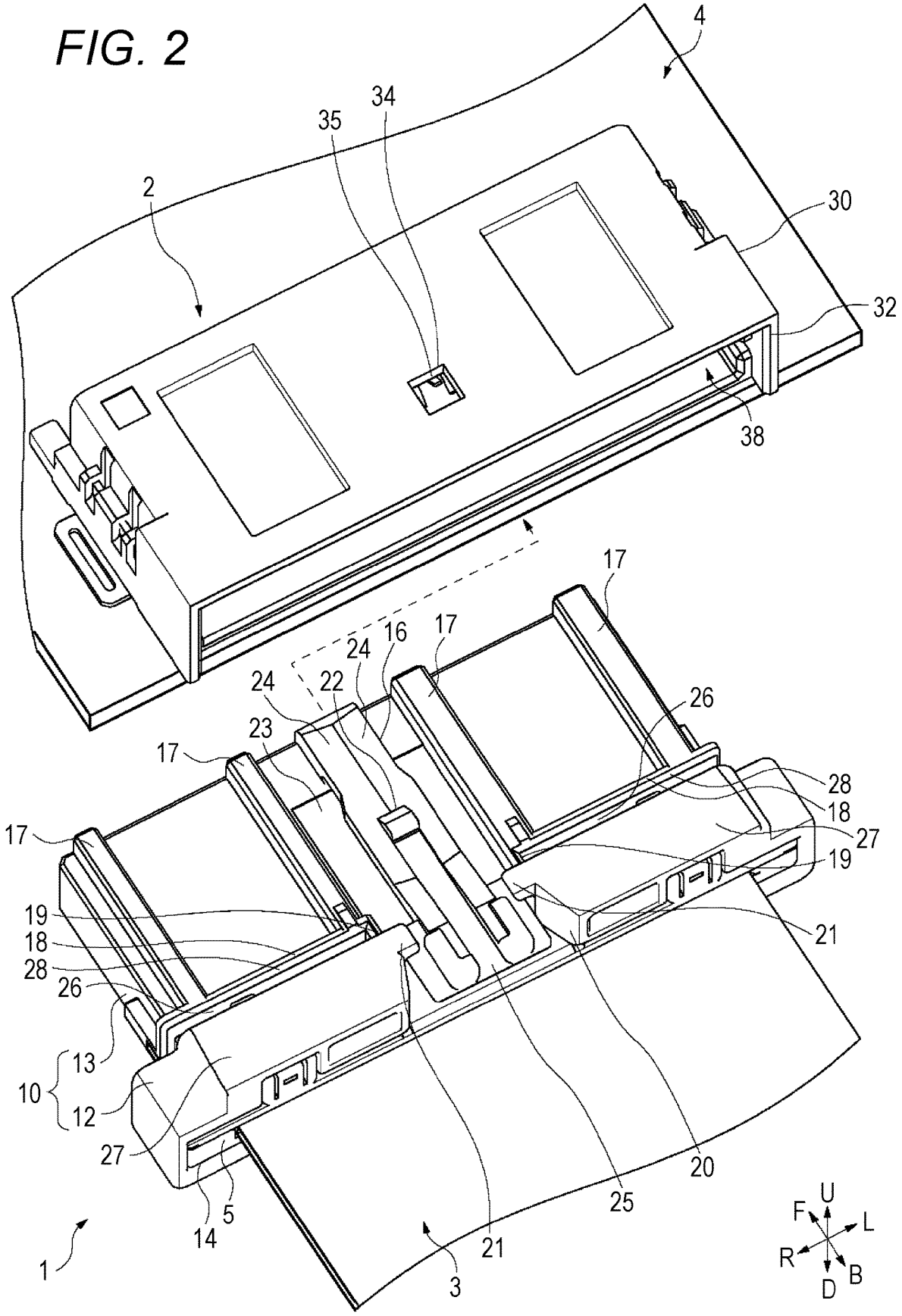
FIG. 2 is a perspective view illustrating a state where the connector according to the embodiment of the invention is removed from the counterpart connector.
Figure 3:
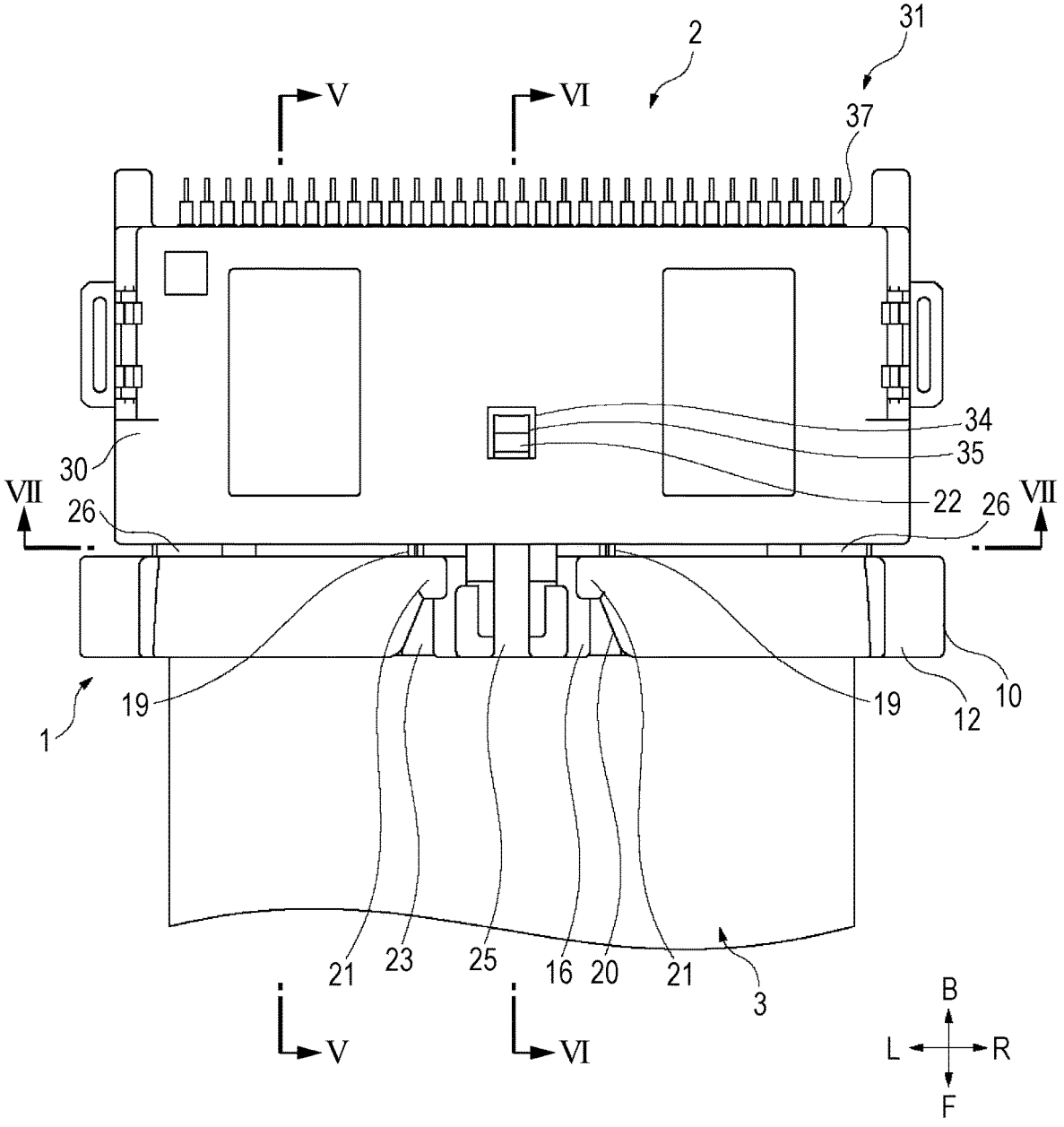
FIG. 3 is a plan view illustrating a state where the connector according to the embodiment of the invention is fitted with the counterpart connector.
Figure 4:
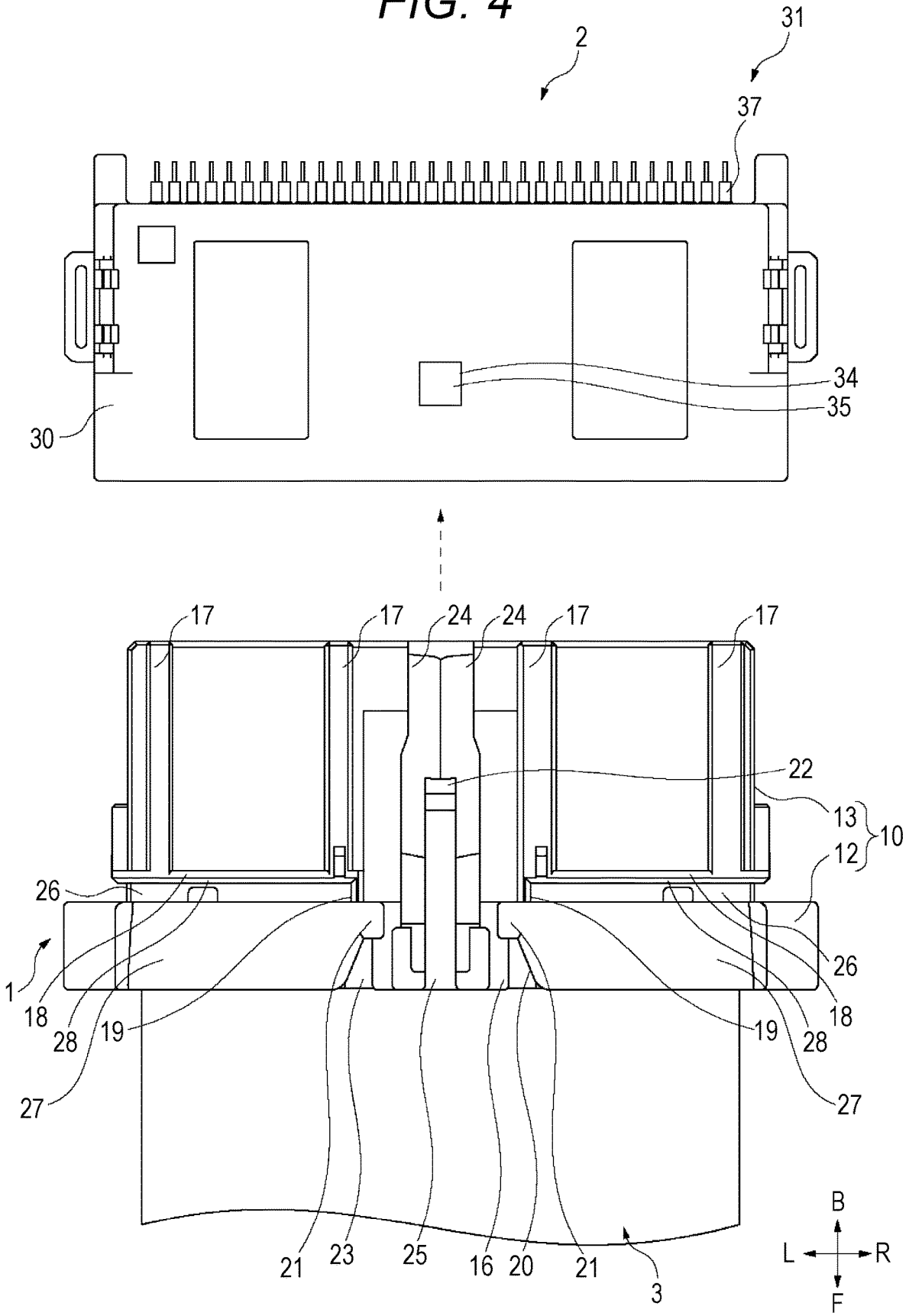
FIG. 4 is a plan view illustrating a state where the connector according to the embodiment of the invention is removed from the counterpart connector.
Figure 5:
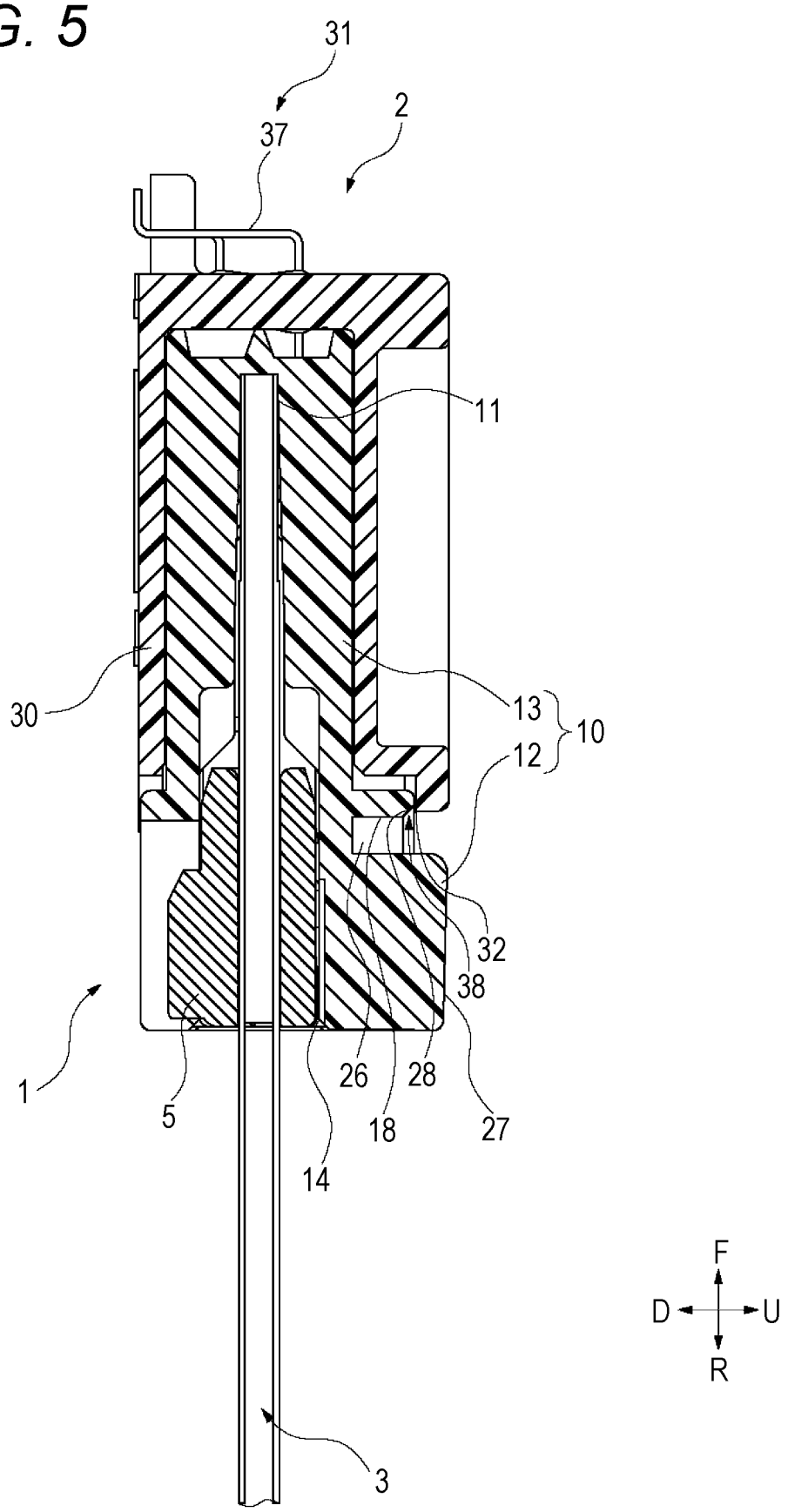
FIG. 5 is a sectional view of the connector and the counterpart connector taken along line V-V in FIG. 3.
Figure 6:
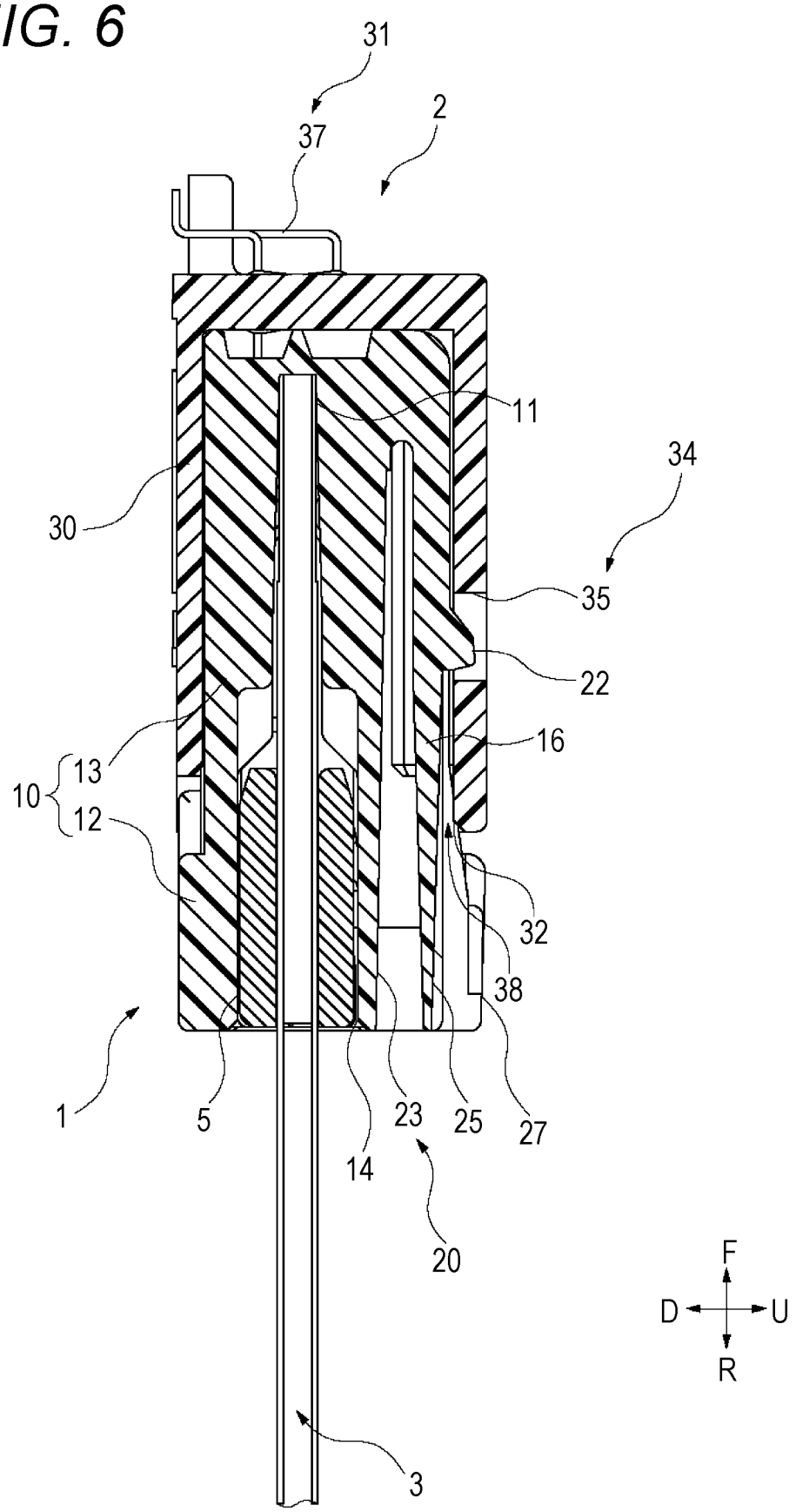
FIG. 6 is a sectional view of the connector and the counterpart connector taken along line VI-VI in FIG. 3.
Figure 7:
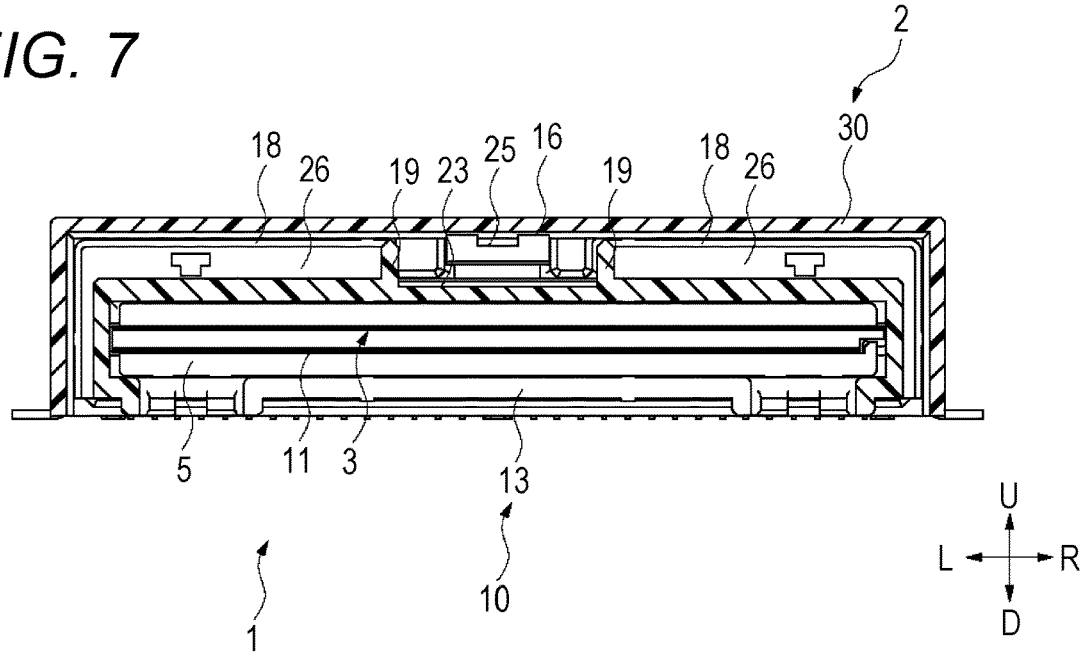
FIG. 7 is a sectional view of the connector and the counterpart connector taken along line VII-VII in FIG. 3.

FIGS. 1 and 2 illustrate the connector 1 according to the embodiment of the invention. Specifically, FIG. 1 is a perspective view of the connector 1 fitted with and thus connected to a counterpart connector. FIG. 2 is a perspective view of the connector 1 removed from and thus not connected with the counterpart connector 2. FIG. 3 is a plan view of the connector 1 fitted with and thus connected to the counterpart connector 2. FIG. 4 is a plan view of the connector 1 removed from and thus not connected with the counterpart connector 2. FIG. 5 is a sectional view taken along line V-V in FIG. 3. FIG. 6 is a sectional view taken along line VI-VI in FIG. 3. FIG. 7 is a sectional view taken along line VII-VII in FIG. 3.

The connector 1 and the counterpart connector 2 are applicable to, for example, an electric device such as a battery pack mounted on a fuel cell vehicle or an electric vehicle. As illustrated in FIGS. 1 and 2, the connector 1 is attached to a tip of a cable 3, and the counterpart connector 2 is mounted on a board 4.

As illustrated in FIGS. 5 and 6, the connector 1 includes a plurality of terminals 11. As illustrated in FIGS. 3, 4, 13, and 14, the counterpart connector 2 includes a plurality counterpart terminals 31 corresponding one-to-one to the plurality of terminals 11. When the connector 1 is fitted with the counterpart connector 2, the terminals 11 are brought into contact with and thus electrically connected to the counterpart terminals 31 in one-to-one correspondence.

Figure 9:
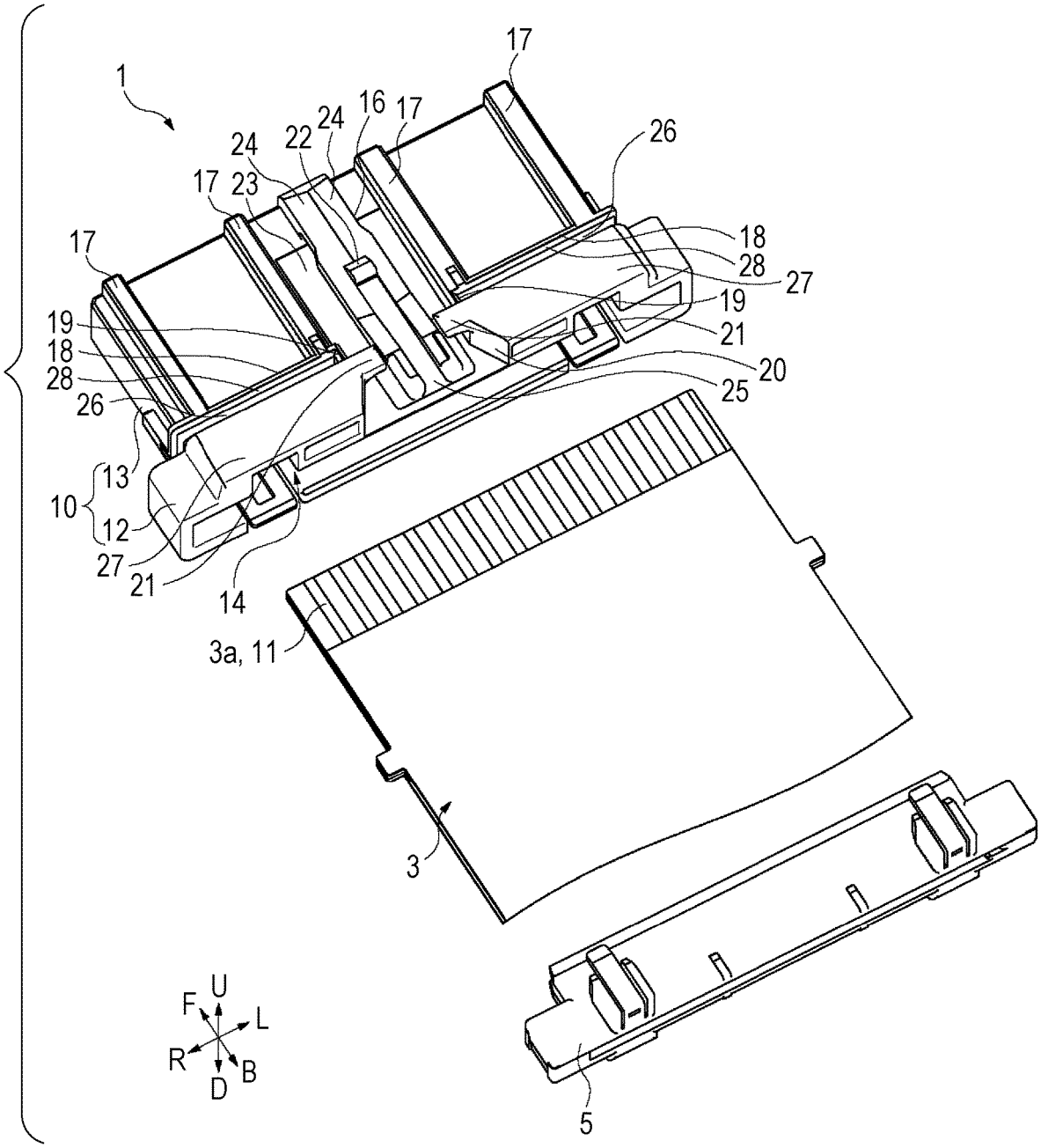
FIG. 9 is an exploded perspective view of the connector, a cable, and a holder according to the embodiment of the invention.

For example, the cable 3 is configured as a flat conductor having flexibility, such as an FPC or an FTC. This improves a space efficiency in wiring. As illustrated in FIG. 9, the cable 3 includes a plurality of conductors. On the tip of the cable 3, contact portions 3*a* are disposed, in one-to-one correspondence, on tips of the conductors. When the connector 1 is attached to the cable 3, the contact portions 3*a* of the cable 3 function as the terminals 11 of the connector 1.

The board 4 has a flat face extending in a front-back direction and a right-left direction. The counterpart connector 2 is mounted on the flat face. For example, the counterpart connector 2 is mounted on an edge part of the board 4 so that an opening 38 of a fitted portion 32 of the counterpart connector 2 to be fitted with the connector 1 is located outside the board 4. The counterpart terminals 31 of the counterpart connector 2 are electrically connected to the board 4. As illustrated in FIGS. 3 and 4, the connector 1 is inserted into or removed from the counterpart connector 2 in an insertion-removal direction corresponding to the front-back direction. That is, a frontward direction corresponds to an insertion direction and a fitting direction of the connector 1 (refer to broken arrows in FIGS. 2 and 4), and a backward direction corresponds to a removal direction of the connector 1.

When the terminals 11 of the connector 1 are electrically connected, in one-to-one correspondence, to the counterpart terminals 31 of the counterpart connector 2, the connector 1 and the counterpart connector 2 are connected to each other, so that the cable 3 and the board 4 are connected to each other.

Figure 8:
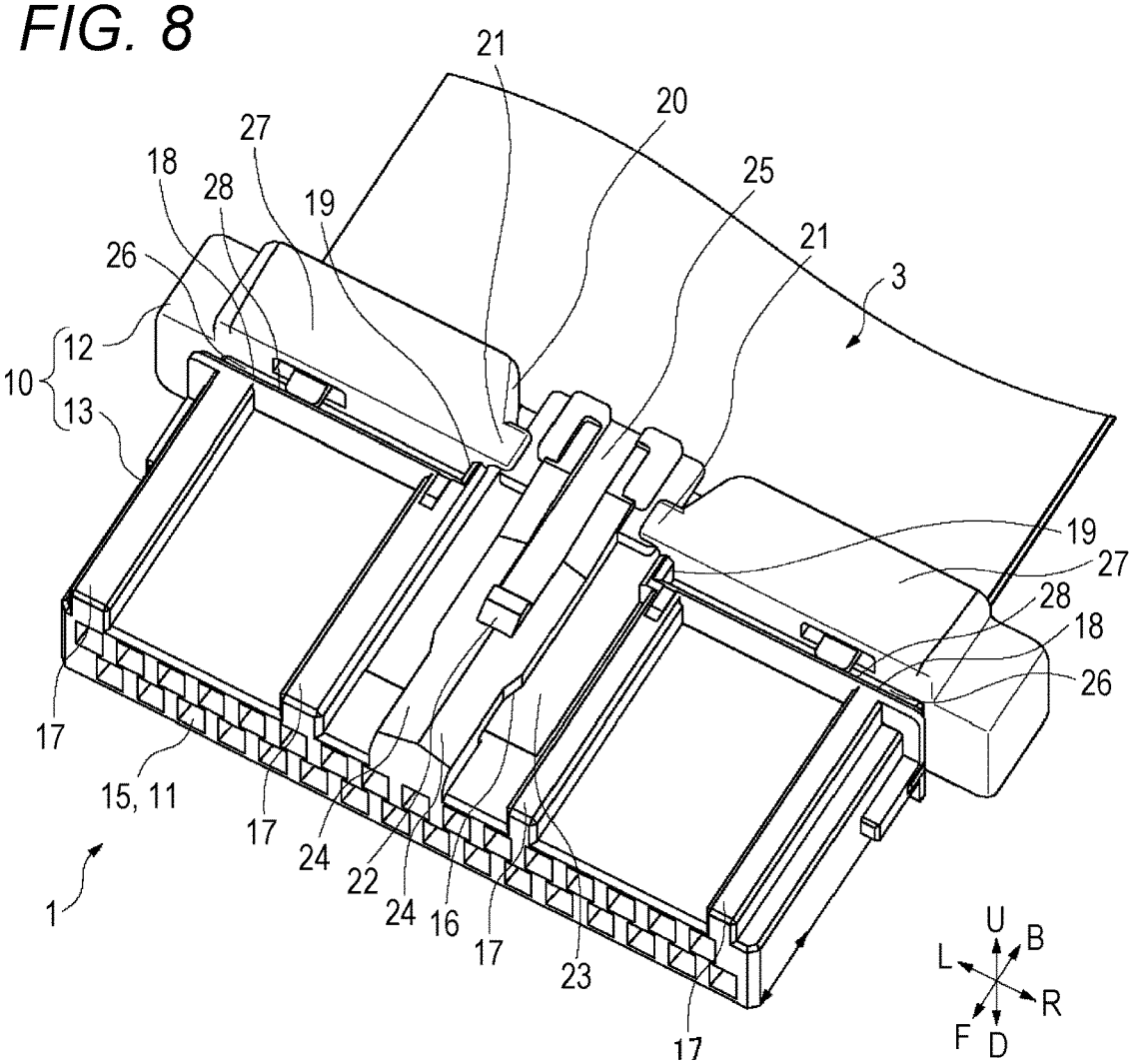
FIG. 8 is a perspective view of the connector according to the embodiment of the invention viewed from the upper front side.
Figure 10:
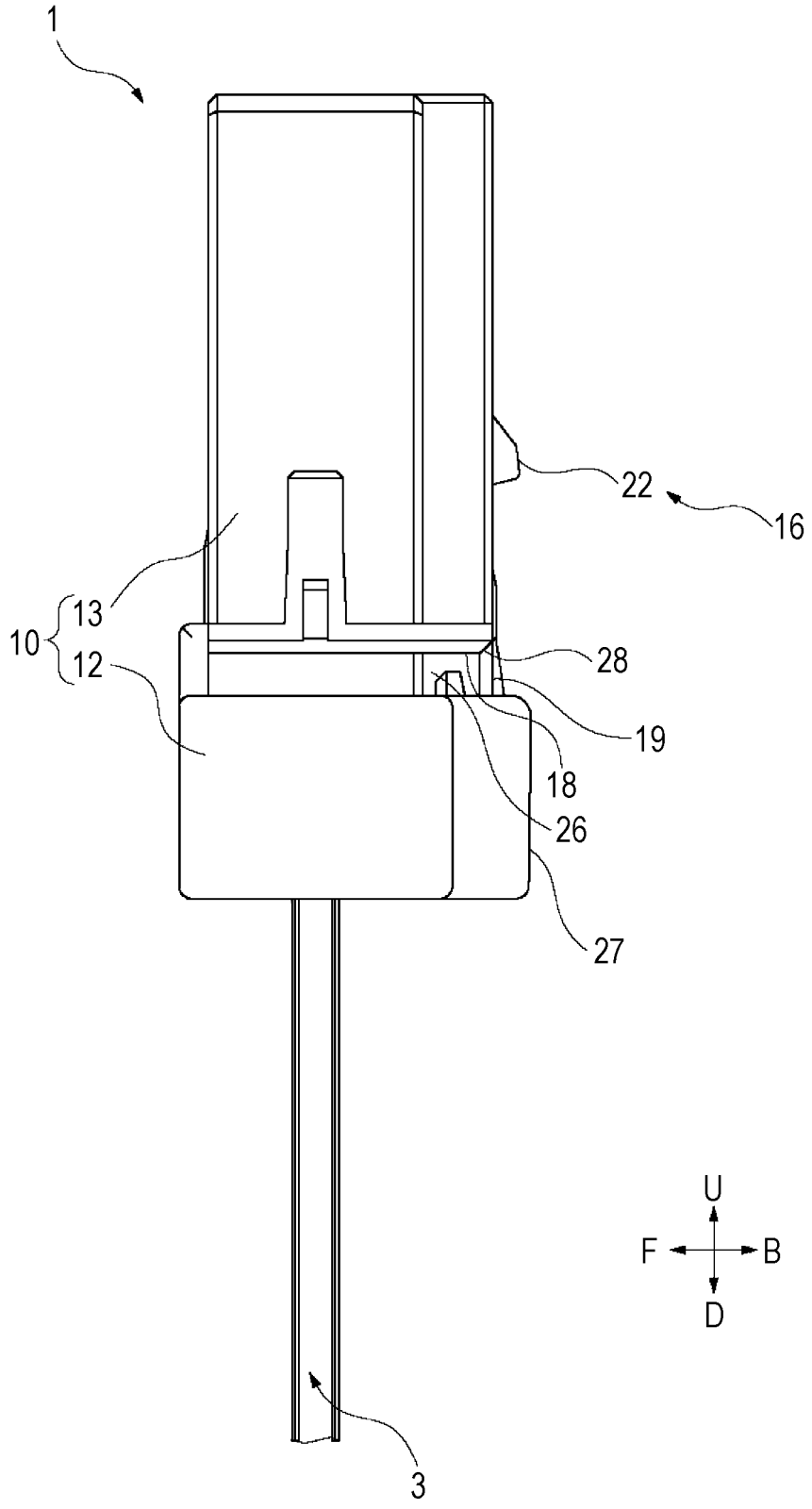
FIG. 10 is a side view of the connector according to the embodiment of the invention.
Figure 11:
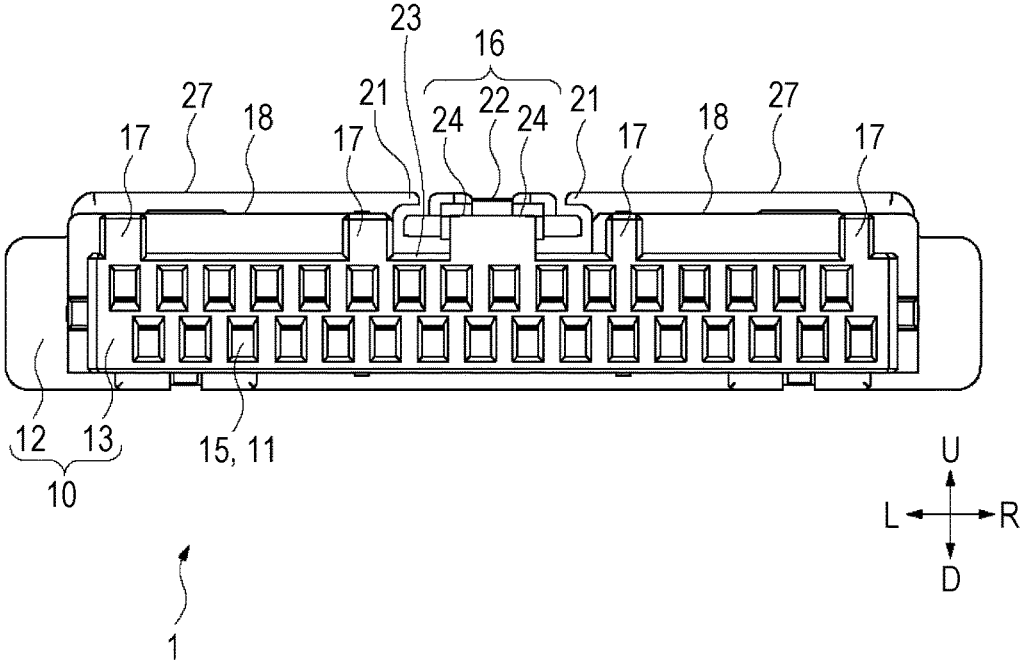
FIG. 11 is a front view of the connector according to the embodiment of the invention.

The connector 1 will be described with reference to FIGS. 8 to 11 in addition to FIGS. 1 to 7. FIG. 8 is a perspective view of the connector 1 viewed from the upper front side. FIG. 9 is an exploded perspective view of the connector 1, the cable 3, and a holder 5. FIG. 10 is a side view of the connector 1 viewed from the right side. FIG. 11 is a front view of the connector 1.

The connector 1 includes a housing 10 that constitutes an outer shape of the connector 1 as illustrated in FIGS. 1 to 11 and includes the terminals 11 mentioned above as illustrated in FIGS. 5 and 6. As illustrated in FIGS. 2, 4, and 8 to 10, the housing 10 is made of an insulating material, such as synthetic resin, and includes a base 12 and a fitting portion 13. The base 12 and the fitting portion 13 are integrated with each other. The housing 10 includes an insertion portion 14 capable of receiving a front end of the cable 3 as illustrated in FIGS. 1 and 2 and includes a plurality of terminal holes 15 capable of receiving, in one-to-one correspondence, the counterpart terminals 31 of the counterpart connector 2 as illustrated in FIG. 11. As illustrated in FIGS. 2, 4, and 8, the housing 10 includes, on an upper face, a locking piece 16 for locking the connector 1 to the counterpart connector 2 and a guide projection 17 for allowing the connector 1 and the counterpart connector 2 to correspond one-to-one to each other.

To position the connector 1 with respect to the cable 3, as illustrated in FIGS. 1, 2, 5, and 6, the holder 5 is attached to the front end of the cable 3 with a predetermined distance from the tip of the cable 3. As illustrated in FIG. 9, the holder 5 is formed in a shape that is housed inside the insertion portion 14 and locked thereto. The holder 5 is detachably attached to the insertion portion 14. Moreover, the holder 5 is formed in a shape that is fixed around the front end of the cable 3. The holder 5 is detachably attached to the cable 3. The cable 3 is inserted into the insertion portion 14 together with the holder 5. At this time, the connector 1 is attached to the cable 3 by locking the holder 5 to the insertion portion 14.

The base 12 is held by a user when the user inserts or removes the connector 1 into or from the counterpart connector 2. The fitting portion 13 is fitted with the counterpart connector 2 together with the locking piece 16 and the guide projection 17. The base 12 has a substantially rectangular parallelepiped outer shape elongated in the right-left direction. The base 12 may have an outer shape larger than a counterpart housing 30 of the counterpart connector 2 so as to be easily held. The fitting portion 13 has a flat and substantially rectangular parallelepiped outer shape smaller in the right-left direction and the up-down direction than the base 12. The fitting portion 13 continuously extends from a front face of the base 12. The fitting portion 13 has an outer shape fittable with the fitted portion 32 of the counterpart housing 30 of the counterpart connector 2. The fitting portion 13 is fitted with the fitted portion 32 in the fitting direction corresponding to the forward direction.

The fitting portion 13 includes a wall 18 on an upper face and right and left side faces thereof. The wall 18 is separated by a predetermined distance from the front face of the base 12 at a back end of the fitting portion 13. The wall 18 extends in a direction intersecting (perpendicular to) the fitting direction of the connector 1, that is, upward and is disposed in a standing manner facing the front face of the base 12. Accordingly, a groove 26 is defined between the wall 18 and the base 12. The groove 26 defined on the outer face of the housing 10 by the wall 18 in this manner is continuous from the upper face to the right and left side faces of the fitting portion 13 and further extends downward. The front face of the base 12 may include, for example, a hole as a configuration for locking the holder 5 of the cable 3.

When the fitting portion 13 is fitted with the fitted portion 32, the wall 18 enters the inside of the fitted portion 32 and faces the outer side, that is, the back side of the counterpart housing 30, and, as illustrated in FIG. 7, closes the opening 38 of the fitted portion 32. When the fitting portion 13 is fitted with the fitted portion 32, the groove 26 between the wall 18 and the front face of the base 12 is located outside the counterpart housing 30 and outside the base 4, that is, not housed in the opening 38 of the fitted portion 32. The wall 18 is integrated with the guide projection 17 to enable improvement in strength.

Although the present embodiment describes an example in which the wall 18 vertically extends upward from the upper face of the fitting portion 13, the present disclosure is not limited to this example. For example, the wall 18 may be inclined downward toward the back side, that is, in the removal direction. The inclined surface of the wall 18 may have a straight cross section or an arc-shaped cross section curved downward when viewed from the left side or the right side. Although the present embodiment describes an example in which the groove 26 has a uniform up-down height throughout in the right-left direction, the present disclosure is not limited to this example. For example, the groove 26 may be inclined downward toward both sides in the right-left direction. The inclined surface of the groove 26 may have a straight cross section or an arc-shaped cross section curved downward when viewed from front side or the back side.

The guide projection 17 is paired with a guide recess 33 of the counterpart connector 2 so as to guide fitting between the connector 1 and the counterpart connector 2 and reduce erroneous fitting. One or more guide projections 17 may be provided. The guide projection 17 projects upward and extends backward from the front end of the upper face of the fitting portion 13 up to the wall 18. The guide projection 17 may be disposed on not only the upper face of the fitting portion 13, but also the right and left side faces of the fitting portion 13. When the fitting portion 13 is fitted with the fitted portion 32, the guide projection 17 is fitted with the guide recess 33. At this time, the guide projection 17 is preferably fitted with the guide recess 33 until a back end of the guide recess 33 reaches the wall 18.

In the present embodiment, the locking piece 16 is disposed on a center in the right-left direction of the upper face of the fitting portion 13. Thus, walls 18 are disposed at the respective right and left sides of the locking piece 16. Each of the walls 18 includes a coupling portion 19 on an end at the central side in the right-left direction. The coupling portion 19 is integrated with the wall 18 to couple the wall 18 to the front face of the base 12. The coupling portion 19 extends in the direction intersecting (perpendicular to) the fitting direction of the connector 1 as with the wall 18 and has a height identical to the height of the wall 18 in the up-down direction. The guide projections 17 are disposed on the upper face of the fitting portion 13 at the respective sides in the right-left direction of the locking piece 16 so as to define a region where the locking piece 16 is disposed on the center in the right-left direction. The guide projections 17 are substantially continuous, in one-to-one correspondence, with the coupling portions 19 in the front-back direction.

To provide the locking piece 16, the base 12 includes a recess 20 on the center in the right-left direction of the upper face of the base 12. The recess 20 penetrates the base 12 in the front-back direction and has a bottom face continuous with the upper face of the fitting portion 13. Right and left side faces of the recess 20 are substantially continuous, in one-to-one correspondence, with the coupling portions 19 in the front-back direction.

As illustrated in FIG. 6, the locking piece 16 is formed in a flat shape elongated in the front-back direction. A front end of the locking piece 16 is connected to the front end of the upper face of the fitting portion 13, and a part of the locking piece 16 other than the front end is separated from the upper face of the fitting portion 13 and the bottom face of the recess 20. Thus, the locking piece 16 is deformable in the up-down direction from the front end as a fulcrum. Restriction pieces 21 are disposed on upper ends of the right and left side faces of the recess 20. The restriction pieces 21 restrict upward deformation of the locking piece 16. Thus, it is possible to reduce excessive deformation of the locking piece 16 to reduce damage of the locking piece 16. When the fitting portion 13 is fitted with the fitted portion 32, the locking piece 16 is locked to a locking portion 34 of the counterpart housing 30 of the counterpart connector 2. For example, the locking piece 16 includes a locking claw 22 engageable with a locking hole 35 of the locking portion 34.

As illustrated in FIGS. 6 and 9, the upper face of the fitting portion 13 and the bottom face of the recess 20 include a first inclined surface 23 at the back side relative to a connection position of the locking piece 16, that is, relative to the front end of the fitting portion 13. The first inclined surface 23 is inclined downward toward the back side, that is, in the removal direction and disposed in a disposing region of the locking portion 34 in the right-left direction. The first inclined surface 23 is disposed in a region defined on the center in the right-left direction by the guide projections 17, the coupling portions 19, and the recess 20. The first inclined surface 23 extends up to a back end of the base 12. The first inclined surface 23 is wider than the locking piece 16 in the right-left direction. In other words, the locking piece 16 is narrower than the first inclined surface 23 in the right-left direction. The first inclined surface 23 preferably has a step at the lower side relative to the front end of the fitting portion 13. The first inclined surface 23 may have a straight cross section or an arc-shaped cross section curved downward when viewed from the left side or the right side.

As illustrated in FIGS. 4, 8, 9, and 11, an upper face of the locking piece 16 includes a second inclined surface 24 inclined downward from the center in the right-left direction toward both sides in the right-left direction. That is, the second inclined surface 24 is inclined toward the first inclined surface 23. The second inclined surface 24 may be inclined downward toward the back side, that is, in the removal direction in addition to the right-left direction. The second inclined surface 24 may have a straight cross section or an arc-shaped cross section curved downward when viewed from the front side or the back side. As illustrated in FIG. 6, the upper face of the locking piece 16 includes a third inclined surface 25 at the back side relative to the locking claw 22. The third inclined surface 25 is inclined downward toward the back side, that is, in the removal direction. The third inclined surface 25 extends up to the back end of the base 12. The upper face of the locking piece 16 may have a recess, and a bottom face of the recess may include the third inclined surface 25. The third inclined surface 25 may have a straight cross section or an arc-shaped cross section curved downward when viewed from the left side or the right side.

The upper face of the base 12 includes a fourth inclined surface 27 inclined downward toward the back side, that is, in the removal direction. The upper face of the base 12 is located on both sides of the recess 20 in the right-left direction. Thus, a left part of the fourth inclined surface 27 on the left upper face of the base 12 and a right part of the fourth inclined surface 27 on the right upper face of the base 12 may be inclined downward from the center in the right-left direction toward the respective sides in the right-left direction. The fourth inclined surface 27 may have a straight cross section or an arc-shaped cross section curved downward when viewed from the left side or the right side.

The wall 18 faces, at the back side thereof, the base 12 and includes a fifth inclined surface 28 in a back upper edge part (the upper edge part in the removal direction) thereof. The fifth inclined surface 28 is inclined downward toward the back side, that is, in the removal direction. When the connector 1 is fitted with and thus connected to the counterpart connector 2, the fifth inclined surface 28 may be inclined from the back end of the counterpart housing 30, may be inclined from the front side relative to the back end of the counterpart housing 30, or may be inclined from the back side relative to the back end of the counterpart housing 30.

An inclination of the first inclined surface 23, the third inclined surface 25, or the fourth inclined surface 27 may be uniform up to the back end of the base 12, may become steeper toward the front side, or may be steep up to the front side relative to the back end of the base 12 and gentle therefrom.

As illustrated in FIGS. 1 and 2, the insertion portion 14 is long in the right-left direction. The insertion portion 14 penetrates the base 12 from the back face of the base 12 and is recessed up to the front end of the fitting portion 13. That is, the forward direction corresponds to the insertion direction of the cable 3 with respect to the connector 1. As illustrated in FIGS. 5 and 6, the insertion portion 14 is capable of housing the cable 3, and a back part of the insertion portion 14 is capable of housing the holder 5 attached to the cable 3. The base 12 and the holder 5 are preferably configured in such a manner that the holder 5 is locked to the base 12.

The contact portions 3*a* of the conductors of the cable 3 serve as the terminals 11. For example, as illustrated in FIG. 9, the contact portions 3*a* of the cable 3 are arranged at intervals in the right-left direction on the upper face of the flat cable 3. The contact portions 3*a* of the cable 3 may be arranged in a plurality of rows in the up-down direction or may be arranged on a lower face of the flat cable 3 in addition to the upper face thereof. As illustrated in FIGS. 8 and 11, the terminal holes 15 are arranged on the front face of the fitting portion 13 at positions corresponding one-to-one to the terminals 11 and communicate with the insertion portion 14.

The terminals 11 are accessible from outside through the respective terminal holes 15. When the fitting portion 13 of the connector 1 is fitted with the fitted portion 32 of the counterpart connector 2, the counterpart terminals 31 of the counterpart connector 2 are inserted, in one-to-one correspondence, into the terminal holes 15 and come into contact, in one-to-one correspondence, with the terminals 11 on the tip of the cable 3 inserted in the insertion portion 14 inside the connector 1. Each of the terminal holes 15 may include, for example, a rib extending backward to guide insertion of the corresponding terminal 11 and guide insertion of the cable 3.

Figure 12:
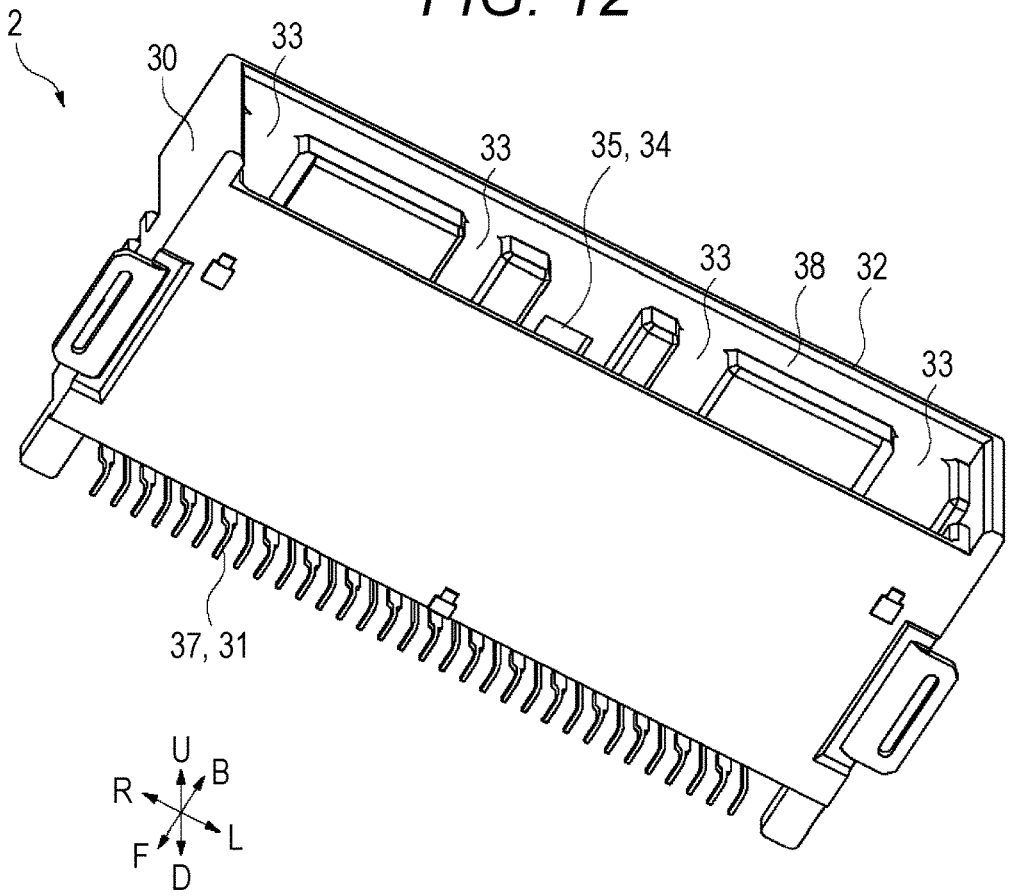
FIG. 12 is a perspective view of the counterpart connector to be fitted with the connector according to the embodiment of the invention viewed from the lower back side.
Figure 13:
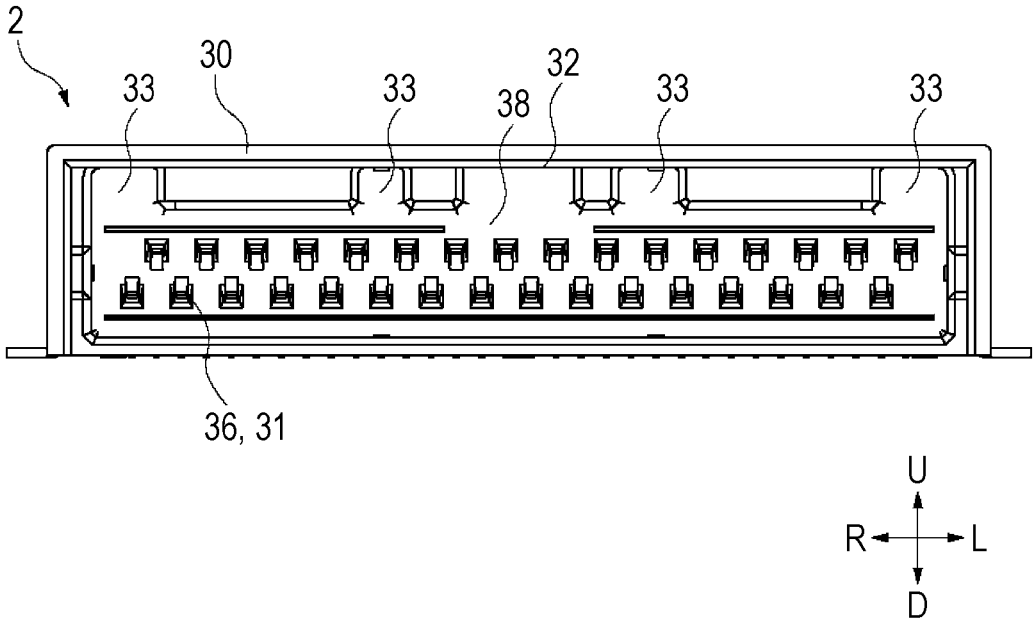
FIG. 13 is a back view of the counterpart connector to be fitted with the connector according to the embodiment of the invention.
Figure 14:
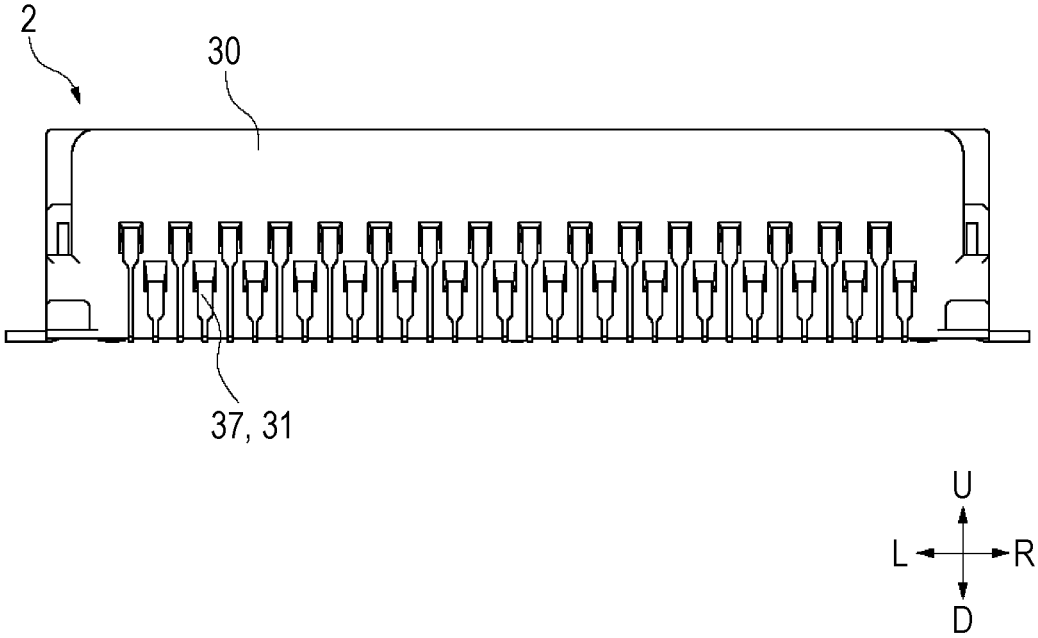
FIG. 14 is a front view of the counterpart connector to be fitted with the connector according to the embodiment of the invention.

The counterpart connector 2 will be described with reference to FIGS. 12 to 14 in addition to FIGS. 1 to 7. FIG. 12 is a perspective view of the counterpart connector 2 viewed from the lower back side. FIG. 13 is a back view of the counterpart connector 2. FIG. 13 is a front view of the counterpart connector. The counterpart connector 2 includes the counterpart housing 30 and the counterpart terminals 31 mentioned above.

As illustrated in FIG. 12, the counterpart housing 30 is made of an insulating material, such as synthetic resin, and formed in a substantially rectangular parallelepiped shape. The counterpart housing 30 includes the fitted portion 32 fittable with the fitting portion 13. The fitted portion 32 includes the opening 38 for inserting or removing the fitting portion 13 on the back face of the counterpart housing 30. The fitted portion 32 is recessed from the back face of the counterpart housing 30 up to the front end of the counterpart housing 30.

An inner upper face and an inner side face of the counterpart housing 30 constitute the fitted portion 32 and include a guide recess 33. The guide recess 33 is paired with the guide projection 17 of the housing 10 of the connector 1 and recessed fittably with the guide projection 17. One or more guide recesses 33 may be provided corresponding to the one or more guide projections 17. The locking portion 34 lockable with the locking piece 16 of the housing 10 of the connector 1 is disposed in an upper part of the counterpart housing 30. For example, the locking portion 34 includes a locking hole 35 for locking the locking claw 22 of the locking piece 16.

As illustrated in FIGS. 12 and 13, the counterpart terminals 31 are arranged on the front face of the counterpart housing 30 at positions corresponding one-to-one to the terminal holes 15, that is, positions corresponding one-to-one to the terminals 11 in the right-left direction and the up-down direction. As illustrated in FIGS. 13 and 14, each of the counterpart terminals 31 includes a projection 36 and a connection portion 37. The projection 36 projects backward from the front face of the counterpart housing 30. The connection portion 37 is exposed forward from the front face of the counterpart housing 30 and electrically connected to the circuit of the board 4 by, for example, soldering.

As described above, in the connector 1 according to the present embodiment, the housing 10 includes the base 12 and the fitting portion 13. The fitting portion 13 is integrated with the base 12 and fittable with the fitted portion 32 of the counterpart housing 30. The fitting portion 13 includes the wall 18. The wall 18 extends in the direction intersecting the fitting direction with respect to the counterpart housing 30 and faces the base 12. When the fitting portion 13 is fitted with the fitted portion 32, the wall 18 closes the opening 38 of the fitted portion 32.

Accordingly, even when water droplets adhere to the upper faces of the connector 1 and the counterpart connector 2 due to condensation in a state where the connector 1 is fitted with and thus connected to the counterpart connector 2, the water droplets easily flow to the outer side relative to the wall 18. Thus, it is possible to reduce water droplets flowing into the clearance between the upper face of the connector 1 and the inner wall of the counterpart connector 2 due to, for example, a capillary phenomenon and reduce entry of water droplets into the counterpart connector 2. Thus, it is possible to reduce water droplets reaching the connection part between the terminal 11 of the connector 1 and the counterpart terminal 31 of the counterpart connector inside the counterpart connector 2. As a result, it is possible to reduce occurrence of a trouble such as a short circuit in the electric circuit or a connection failure.

In the connector 1 according to the present embodiment, the wall 18 defines the groove 26 on the outer face of the housing 10. The groove 26 is continuous from the upper face to the side faces of the housing 10 and further extends downward. Accordingly, water droplets flowing to the outside of the wall 18 is discharged to the outside of the connector 1 through the groove 26 defined by the wall 18 without being accumulated outside the wall 18. Thus, the possibility of water droplets entering the inside of the counterpart connector 2 can be further reduced. Therefore, it is possible to further reduce the possibility of water droplets reaching the connection part between the terminal 11 and the counterpart terminal 31. As a result, it is possible to further reduce the possibility of occurrence of a trouble such as a short circuit in the electric circuit or a connection failure.

The connector 1 according to the present embodiment includes the locking piece 16 configured to lock the housing 10 to the counterpart housing 30 on the outer face of the housing 10. The locking piece 16 has a first end (front end) connected to the outer face (upper face) of the housing 10 and a second end (back end) separated from the outer face (upper face) of the housing 10. The wall 18 is disposed in a region other than the disposing region of the locking piece 16 on the outer face of the housing 10. The housing 10 includes the first inclined surface 23 inclined downward in the removal direction of the connector 1 in the disposing region of the locking piece 16 at the second end side.

Accordingly, in a region where the wall 18 is difficult to place due to the configuration of locking the connector 1 to the counterpart connector 2, the first inclined surface 23 enables water droplets adhering to the upper faces of the connector 1 and the counterpart connector 2 to be discharged to the back side of the connector 1 through the first inclined surface 23. Since the locking piece 16 is separated from the first inclined surface 23, the discharge of water droplets is not obstructed by the locking piece 16. Moreover, since the first inclined surface 23 penetrates the base 12 and extends up to the back end of the base 12, the discharge of water droplets is not obstructed by the base 12. Although the cable 3 extends at the back side of the connector 1, the holder 5 can reduce water droplets on the cable 3 flowing to the connector 1. Moreover, when the cable 3 having flexibility is curved downward, water droplets do not flow to the connector 1.

In the connector 1 according to the present embodiment, the locking piece 16 includes, on the upper face, the second inclined surface 24 inclined toward the first inclined surface 23. This enables water droplets adhering to the locking piece 16 to be discharged to the first inclined surface 23 through the second inclined surface 24 and further to the back side of the connector 1 through the first inclined surface 23.

In the connector 1 according to the present embodiment, the locking piece 16 includes, on the upper face, the third inclined surface 25 inclined downward in the removal direction of the connector 1. This enables water droplets adhering to the locking piece 16 to be discharged to the back side of the connector 1 through the third inclined surface 25.

Although the above embodiment describes an example in which the first inclined surface 23 extends up to the back end of the base 12 in the front-back direction, the present disclosure is not limited to this example. For example, as a modification, as illustrated in FIGS. 15 to 18, in a connector 60 similar to the connector 1 of the above embodiment, the housing 10 includes a first inclined surface 61 similar to the first inclined surface 23 of the above embodiment on the upper face of the fitting portion 13 and the bottom face of the recess 20. Description for a structure of the connector 60 similar to the structure of the connector 1 of the above embodiment will be omitted. In particular, description for a structure of the first inclined surface 61 similar to the structure of the first inclined surface 23 of the above embodiment will be omitted.

Figure 15:
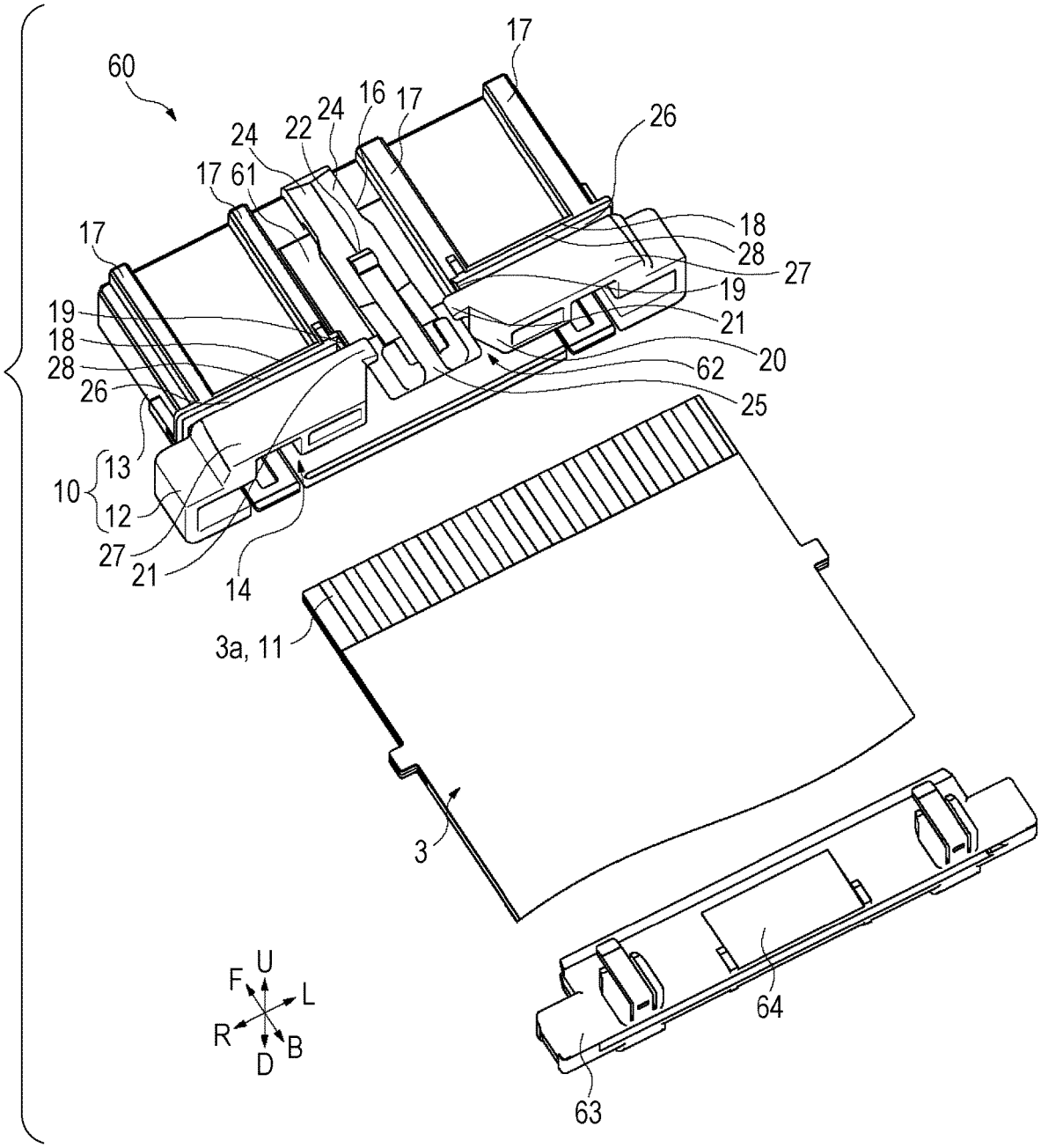
FIG. 15 is an exploded perspective view of a connector, a cable, and a holder according to a modification of the embodiment of the invention.
Figure 16:
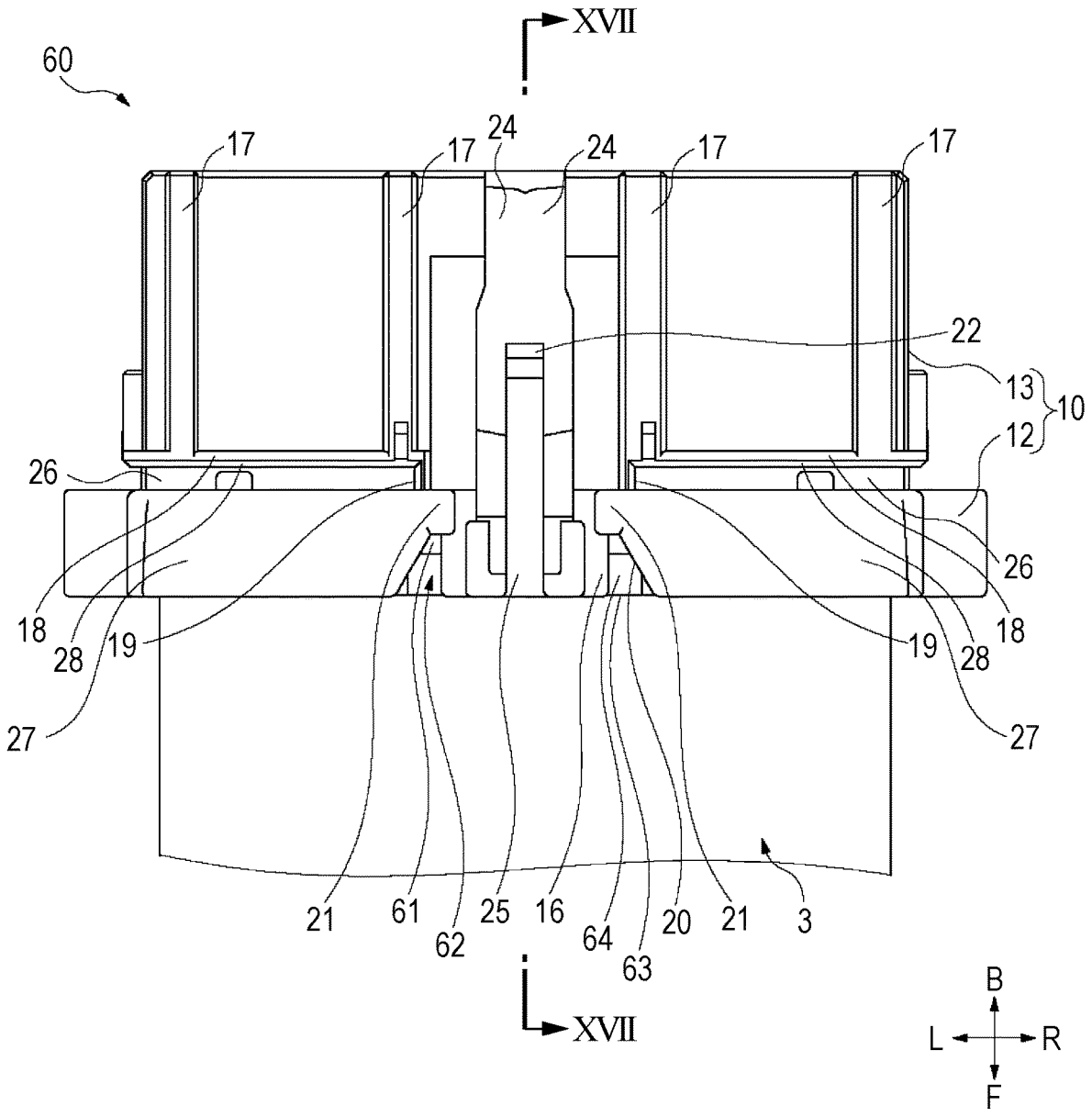
FIG. 16 is an exploded perspective view of the connector, the cable, and the holder according to the modification of the embodiment of the invention.
Figure 17:
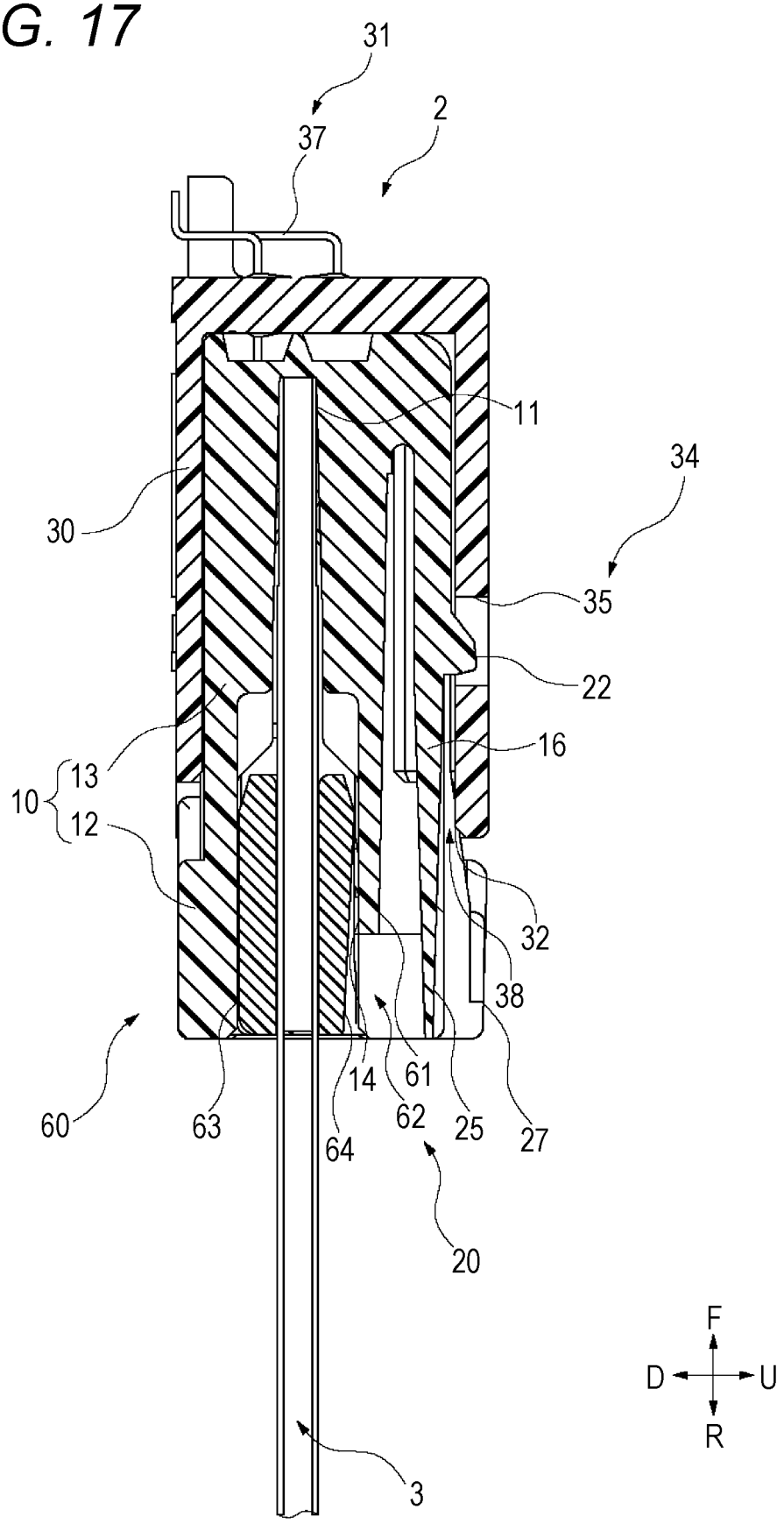
FIG. 17 is a sectional view of the connector, the cable, and the holder taken along line XVII-XVII in FIG. 16.
Figure 18:
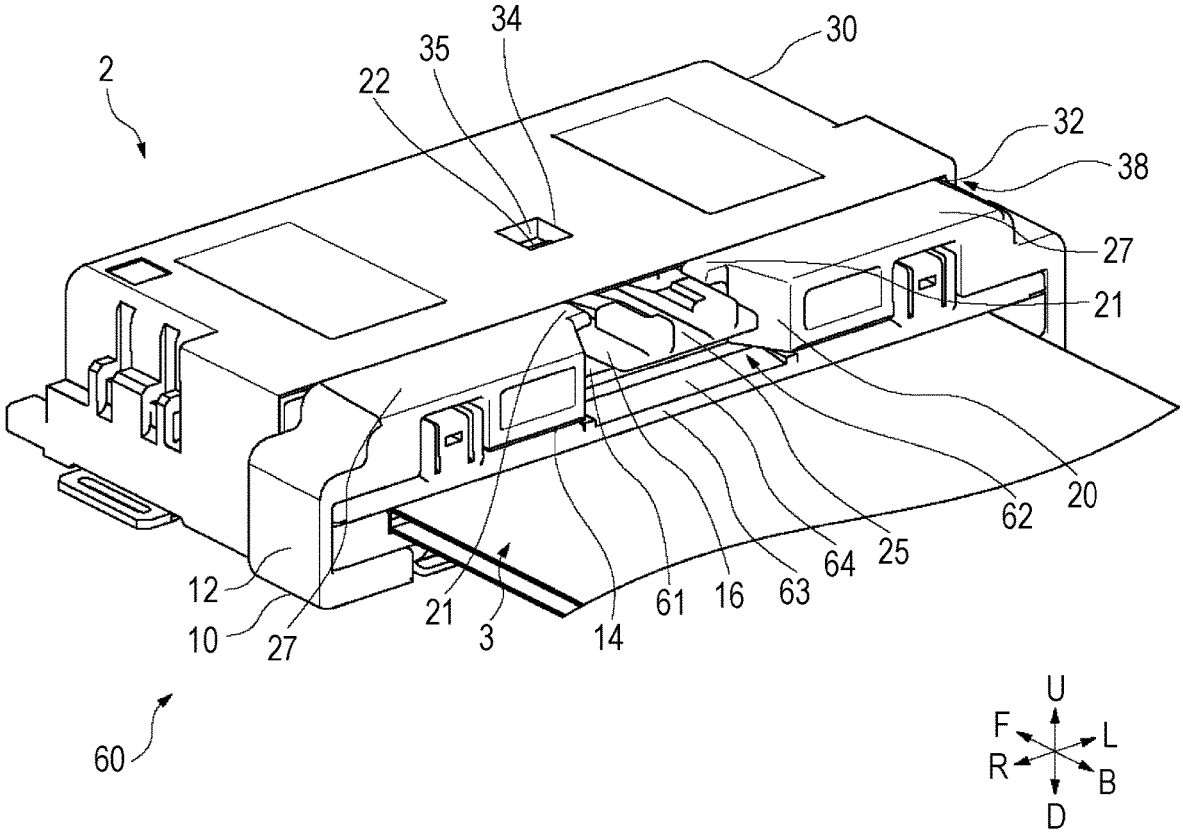
FIG. 18 is a perspective view of the connector, the cable, and the holder according to the modification of the embodiment of the invention viewed from the back side.

FIG. 15 is an exploded perspective view of the connector 60 and a holder 63 according to the modification. FIG. 16 is a plan view of the connector 60 and the holder 63 according to the modification. FIG. 17 is a sectional view taken along line XVII-XVII in FIG. 16. FIG. 18 is a perspective view of the connector 60 and the holder 63 according to the modification viewed from the back side.

As illustrated in FIGS. 16, 17, and 18, the first inclined surface 61 extends up to an intermediate part of the recess 20 of the base 12 and preferably extends up to a position corresponding to the back ends of the restriction pieces 21 in the front-back direction. In other words, the bottom face of the recess 20 includes a cut 62 having a trapezoidal shape in top view at the back side of the first inclined surface 61. This enables the locking piece 16 to largely deform downward through the cut 62 to facilitate removal of the connector 60 as compared to the case where the cut 62 is not provided.

Since the first inclined surface 61 extends up to the position corresponding to the back ends of the restriction pieces 21 in the front-back direction, it is possible to restrict upward deformation of the locking piece 16 by the restriction pieces 21 and restrict downward deformation of the locking piece 16 by the first inclined surface 61. Thus, it is possible to reduce excessive deformation of the locking piece 16 to reduce damage of the locking piece 16.

Although the above modification describes an example in which the first inclined surface 61 extends up to the position corresponding to the back ends of the restriction pieces 21, the present disclosure is not limited to this example. The first inclined surface 61 may extend up to the front end of the base 12, that is, to the back end of the fitting portion 13.

As described in FIGS. 15 to 18, in the above modification, the holder 63 similar to the holder 5 of the above embodiment is configured to hold the cable 3. Description for a structure of the holder 63 similar to the structure of the holder 5 of the above embodiment will be omitted.

The holder 63 includes, on an upper face, a sixth inclined surface 64 inclined downward toward the back side, that is, in the removal direction. The sixth inclined surface 64 is disposed in a back part of the upper face of the holder 63 and preferably disposed at a position corresponding to the cut 62 on the bottom face of the recess 20 of the base 12 in a state where the holder 63 is inserted in the insertion portion 14 of the housing 10. The sixth inclined surface 64 at least extends backward from the front side relative to the back end of the first inclined surface 61 in the front-back direction. The sixth inclined surface 64 may have a straight cross section or an arc-shaped cross section curved downward when viewed from the left side or the right side.

In this manner, even when, in the connector 60, the first inclined surface 61 of the housing 10 does not extend up to the back end of the housing 10, the sixth inclined surface 64 on the upper face of the holder 63 enables water droplets flowing backward from the first inclined surface 61 to flow toward the cable 3 through the sixth inclined surface 64. Thus, it is possible to reduce water droplets reaching the connection part between the terminal 11 of the connector 60 and the counterpart terminal 31 of the counterpart connector 2 inside the counterpart connector 2. As a result, it is possible to reduce occurrence of a trouble such as a short circuit in the electric circuit or a connection failure.

Although the present embodiment describes an example in which the connector 1 or 60 attached to the cable 3 includes the fitting portion 13, the counterpart connector 2 mounted on the board 4 includes the fitted portion 32, and the connector 1 or 60 is fitted with the opening 38 of the counterpart connector 2, the present disclosure is not limited to this example. The connector 1 or 60 may include a fitted portion, and the counterpart connector 2 may include a fitting portion.

Although the present embodiment describes an example in which the first inclined surface or 61 of the housing 10 and the third inclined surface 25 of the locking piece 16 are inclined downward toward the back side, that is, in the removal direction, the present disclosure is not limited to this example. For example, the first inclined surface 23 or 61 and the third inclined surface 25 may only be inclined toward the outer side of the housing 10, and may be inclined toward the right and left sides when disposed on right and left edges of the housing 10.

Although the present embodiment describes an example in which the locking piece 16 is disposed on the center in the right-left direction of the upper face of the housing 10, the present disclosure is not limited to this example. For example, the locking piece 16 may be disposed in a part other than the upper face of the housing 10. In this case, the wall 18 may extend across the upper face of the fitting portion 13 of the housing 10 in the right-left direction. Moreover, the locking piece 16 may be disposed at a position other than the center in the right-left direction on the upper face of the housing 10. In this case, the wall 18 may be disposed at a position avoiding the locking piece 16 in the right-left direction.

The present embodiment describes an example in which the cable 3 is configured as the flat conductor, such as an FPC or and FFC. However, in the present disclosure, the cable 3 is not limited to the flat conductor and may be configured as another conductor.

The present embodiment describes an example in which the board 4 includes the flat face extending in the front-back direction and the right-left direction, and the counterpart connector 2 is mounted on the flat face. However, in the present disclosure, the structure of the board 4 and the mounting position of the counterpart connector 2 are not limited to this example.

The present disclosure can be appropriately modified without departing from the gist or idea of the invention readable from the claims and the entire specification, and such modifications of the connector are also included in the technical idea of the invention.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A connector comprising a housing fittable with a fitted portion of a counterpart housing of a counterpart connector, the housing including a base, and a fitting portion integrated with the base and fittable with the fitted portion, the fitting portion extending in a direction intersecting a fitting direction with respect to the counterpart housing and facing the base, the fitting portion including a wall configured to close an opening of the fitted portion when the fitting portion is fitted with the fitted portion.

2. The connector according to claim 1, wherein the wall defines a groove on an outer face of the housing, and the groove is continuous from an upper face to a side face of the housing and further extends downward.

3. The connector according to claim 1, further comprising a locking piece configured to lock the housing to the counterpart, the locking piece being disposed on an outer face of the housing, wherein the locking piece has a first end connected to the outer face of the housing and a second end separated from the outer face of the housing, the wall is disposed in a region other than a disposing region of the locking piece on the outer face of the housing, and the housing includes a first inclined surface inclined downward in a removal direction of the housing in the disposing region of the locking piece at the second end side.

4. The connector according to claim 3, wherein the locking piece includes, on an upper face, a second inclined surface inclined toward the first inclined surface.

5. The connector according to claim 3, wherein the locking piece includes, on an upper face, a third inclined surface inclined downward in the removal direction of the housing.

6. The connector according to claim 1, wherein the base includes, on an upper face, a fourth inclined surface inclined downward in a removal direction of the housing.

7. The connector according to claim 1, wherein the wall includes, in an upper edge part in a removal direction of the housing, a fifth inclined surface inclined downward in the removal direction of the housing.

8. The connector according to claim 3, further comprising a holder attached to the housing while positioning a cable, wherein the first inclined surface includes a cut on an end in the removal direction, and the holder includes, on an upper face, a sixth inclined surface inclined downward in the removal direction of the housing at a position corresponding to the cut when the holder is attached to the housing.

* * * * *